US006085432A

United States Patent [19]

Van der Sluis et al.

[11] Patent Number: 6,085,432

[45] Date of Patent: Jul. 11, 2000

[54] POSITIONING DEVICE

[75] Inventors: Albert Van der Sluis, Steenwijk; Yme Poortvliet, Wartena, both of Netherlands

[73] Assignee: Ingenieursbureau Oranjewoud B.V., Netherlands

[21] Appl. No.: 08/857,707

[22] Filed: May 16, 1997

[30] Foreign Application Priority Data

May 17, 1996 [NL] Netherlands ..... 1003156

[51] Int. Cl.[7] ..... E04H 12/22

[52] U.S. Cl. ..... 33/613; 33/1 H; 269/904; 52/749.1

[58] Field of Search ..... 33/1 G, 1 H, 1 M, 33/613, 645, 671, 673, 675, 678; 52/731.7, 741.14, 749.1; 269/55, 57, 904

[56] References Cited

U.S. PATENT DOCUMENTS

| | | | |
|---|---|---|---|
| 404,858 | 6/1889 | Painter | 33/673 |
| 1,344,162 | 6/1920 | Arnold | 33/1 H |
| 1,609,912 | 12/1926 | Mazeau | 33/1 H |
| 1,679,297 | 7/1928 | Ehrler | 52/741.14 |
| 3,241,243 | 3/1966 | Speer | 33/1 M |
| 3,318,010 | 5/1967 | Mahl | 3/671 |
| 3,430,349 | 3/1969 | Bunton et al. | 33/645 |
| 4,047,356 | 9/1977 | DePirro | 52/749.1 |
| 5,163,233 | 11/1992 | Benson | 269/904 |
| 5,794,387 | 8/1998 | Crookham | 52/749.1 |

FOREIGN PATENT DOCUMENTS

| | | | |
|---|---|---|---|
| 0 555 517 | 8/1993 | European Pat. Off. . | |
| 32 04 103 | 8/1983 | Germany . | |
| 159296 | 9/1962 | U.S.S.R. | 33/1 H |

*Primary Examiner*—G. Bradley Bennett
*Attorney, Agent, or Firm*—Mark Zovko

[57] ABSTRACT

The invention relates to a device for positioning an upright with a desired orientation in order to mount thereon a superstructure such as a post of a pylon. The device is characterized by a frame, and a rotation mechanism connected to the frame for rotation in a plane round a standing axis, wherein the rotation mechanism comprises coupling means for coupling the upright thereto at the desired angle of inclination.

9 Claims, 2 Drawing Sheets

POSITIONING DEVICE

The present invention relates to a device for positioning an upright with a desired orientation in order to mount thereon a superstructure such as a post of a pylon.

In the positioning of an upright, and in particular for mounting thereon a post of a pylon, a high degree of precision is required. In the case of a pylon any minimal deviation in the angle of inclination of the upright, the height of the upright and/or convergence of the post results in great problems in respect of the construction of the mast, since in upward direction the posts must converge in one point at great height.

No device is known in the art for positioning an upright at a desired orientation, with which desired accuracies can be effected in simple manner.

The invention has for its object to provide a device which is distinguished by: a frame; and a rotation mechanism connected to the frame for rotation in a plane round a standing axis, wherein the rotation mechanism comprises coupling means for coupling the upright thereto at the desired angle of inclination.

Through coupling of the upright to the coupling means at the desired angle of inclination and through rotation in an approximately horizontal plane round a standing axis, positioning of an upright is brought about in the desired orientation.

In a preferred embodiment a device according to the present invention comprises a translation mechanism arranged between the frame and the rotation mechanism for translation of the upright parallel to the plane of rotation.

In this preferred embodiment the frame does not have to be moved when the bottom part of the upright must be displaced, for instance after rotation of the rotation mechanism.

Usually, and particularly in the case of uprights for posts of pylons, adjustment of the height to which the upright extends is also of importance. In a device according to the present invention in a third preferred embodiment the frame therefore comprises at least three legs which comprise adjusting means to adjust the height thereof.

Uniform adjustment of the adjusting means associated with each of the legs brings about a raising or lowering of the plane of rotation and the height of the upright related thereto. Moreover, separate adjustment of the adjusting means associated with each of the legs can result in the position of the plane of rotation being adjusted. This is particularly important in the case of an uneven ground on which the frame is placed, so that the plane of rotation can be made horizontal using the adjusting means. In addition, separate adjustment of the adjusting means associated with each of the legs can likewise provide compensation for material unevenness on the surface of the coupling means and/or the upright, as a result of which the angle of inclination of the upright coupled to the coupling means is not the desired one. In this case the plane of rotation is made non-horizontal in order to realize the desired angle of inclination related to the non-horizontal position by adjusting the adjusting means associated with the individual legs.

In yet another preferred embodiment of a device according to the present invention the coupling means are fixed releasably to the rotation mechanism and comprise a coupling part, the form of which is suitable for coupling thereto of the upright to be used at an angle of inclination related thereto.

This is particularly important to enable positioning with a device according to the present invention of different types of uprights having different shapes and individual desired angles of inclination related thereto.

The invention is further elucidated with reference to the figure description following hereinafter of an embodiment of the invention. In the drawing.

Figure 1:
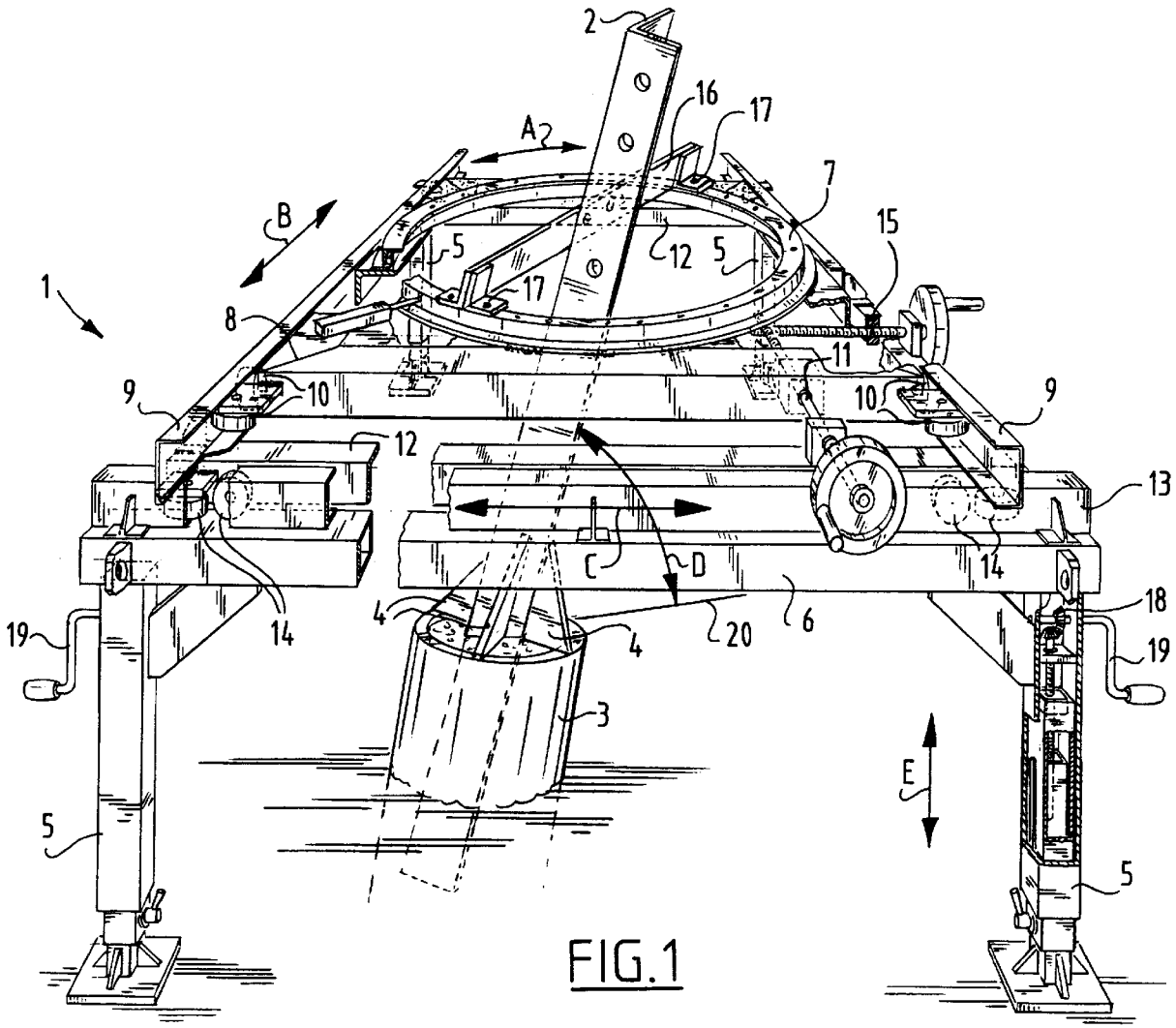
FIG. 1 shows a device according to the present invention.

The positioning table 1 shown in FIG. 1 as embodiment of a device according to the present invention is applied here to position a corner post 2 as upright. A mast (not shown) usually rests on four iron tubes 3 which protrude from the ground and which are arranged in the ground at a determined angle of inclination relative to the vertical which approximates the desired one and roughly in the direction of the top of the mast. The corner posts 2 must be fixed in the tubes 3 at an orientation related to the type of corner post and the type of pylon to be constructed, for instance by welding iron strips 4 to corner posts 2 and iron tubes 3. The positioning table 1 as embodiment of the device according to the present invention therefore has a double function: positioning corner posts 2 at a desired orientation; and fixing thereof during the mounting of corner post 2 in iron tube 3.

The positioning table 1 substantially comprises: a frame designed as legs 5 with connecting profiles 6 therebetween; and a rotation mechanism designed as a turntable 7 for rotation in the direction designated with arrow A. With use of turntable 7 the adjustment of the direction of the projection of corner post 2 is therefore made in a plane of rotation corresponding with turntable 7.

Turntable 7 is mounted on a table 8 which is displaceable between the C-shaped guide profiles 9 in the direction designated with arrow B. For this purpose bearings 10 running in the guide profiles 9 are mounted on table 8 and a jack 11 engages the table 8 to effect displacement in the direction designated with arrow B, wherein the direction designated with arrow B is parallel to the plane of rotation associated with turntable 7.

Guide profiles 9 are fixed onto L-shaped support profiles 12. The assembly of turntable 7, table 8, guide profiles 9 and support profiles 12 is displaceable between C-shaped guide profiles 13 in the direction designated with arrow C. Bearings 14 running in guide profiles 13 are arranged for this purpose on support profiles 12 and a jack 15 engages the table 8 to effect displacement in the direction designated with arrow C, wherein the direction designated with arrow C is parallel to the plane of rotation associated with turntable 7. Guide profiles 13 are fixed on the connecting profiles 6. The assembly of guide profiles 9, 13, bearings 10, 14 and jacks 11, 15 forms a translation mechanism for translation of turntable 7 in directions which are parallel to the plane of rotation associated with turntable 7.

The corner post 2 is fixedly coupled to coupling plate 16, which is fixed by means of attachments 17 to turntable 7 at the desired angle of inclination with the plane of rotation of turntable 7, when the plane of rotation of turntable 7 is exactly horizontal. This angle of inclination corresponds in this case with the angle designated with arrow D between the horizontal 20 and the corner post 2. The horizontal 20 is a projection of corner post 2 in the horizontal plane which runs through the top part of tube 3. This plane of rotation can be made horizontal using jacks 18 and handles 19 arranged in the legs 5 for adjusting the length of each of the legs 5 in the direction designated with arrow E. When in the case of a plane of rotation which has been made horizontal the angle of inclination of corner post 2 is not the desired one as a result of unevenness of the surface of corner post 2 and/or of coupling plate 16, this can be remedied by adjusting the length of the legs 5 to effect the desired angle of inclination, wherein however the plane of rotation is of course carried out of its horizontal position. The adjusting means in legs 5 comprising the jacks 18 for the purpose of adjusting the length of the legs can in any case be used to first place into the horizontal state thereof the plane of rotation of a positioning table 1 arranged on an uneven ground surface. Possible unevenness on the surface of corner post 2 and/or coupling plate 16 can subsequently be remedied.

Figure 2:
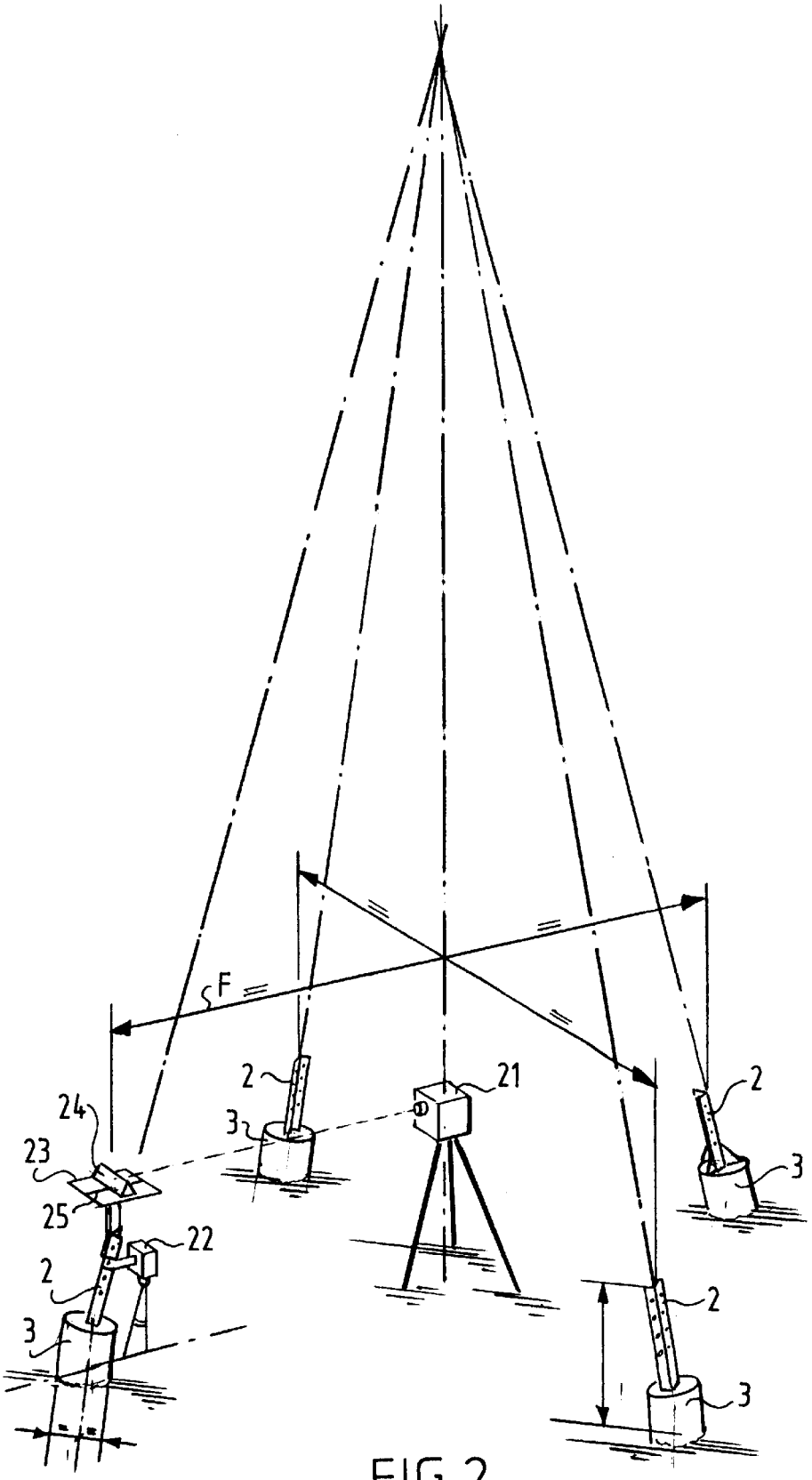
FIG. 2 shows a representation of the principle of the manner in which the device according to the present invention must be applied.

FIG. 2 shows a representation of the manner in which each of the corner posts 2 is positioned using the positioning table 1 shown in FIG. 1. This comprises the following steps.

The centre of the upper side of tubes 3 is determined after determining of the position of these upper sides of tubes 3 in a coordinate system using a tachymeter 21. Some shifting of the centre, and therefore of corner posts 2, is still possible herein as a result of play between tubes 3 and corner posts 2 in order to also enable optimum centering of corner posts 2 in tubes 3.

The corner post 2 is coupled to the positioning table 1 according to the present invention shown in FIG. 1, wherein the underside of corner post 2 is placed in the tube 3. An inclinometer 22 and a mirror plate 23 are subsequently fixed to corner post 2, these being necessary to enable performing of the measurement described hereinbelow with the tachymeter 21.

With tachymeter 21 the following measurements are carried out:

determining of the direction of preferably the centre of the mast to the heart of the corner post on the basis of aligning marks in the mast line direction (the tachymeter can per se also be disposed at a location other than the centre of the mast);

determining of the rotation on the vertical axis on the basis of a line 25 on the mirror plate 23;

determining of the height of corner post 2;

determining of the upright position of the corner post relative to the vertical perpendicularly of the direction of the centre to the corner post;

determining of the horizontal distance between tachymeter 21 and the prism, which distance is designated with arrow F; and determining of the angle of inclination relative to the vertical in the direction between the centre and the corner post using the inclinometer.

The following steps are then performed.

On the basis of the above described measurements deviations in the measuring results relative to the desired orientation are determined, which can take place with a computing unit and a control program processing the measurement results.

The deviations are remedied by adjusting the settings of the device according to the present invention, in FIG. 1 positioning table 1;

The corner post 2 is welded into the tube 3 in the desired orientation, wherein corner post 2 remains coupled to the device;

The tube 3 is filled with concrete;

The superstructure, such as a pylon, is mounted on the corner post 2, for instance by means of bolts (not shown).

What is claimed is:

1. Device for positioning an upright with a desired orientation in order to mount thereon a superstructure such as a post of a pylon, comprising a frame; and a rotation mechanism connected to the frame for rotation in a plane round a substantially vertical axis, wherein the rotation mechanism comprises a coupling for fixing the upright thereto at a predetermined desired angle of inclination.

2. Device as claimed in claim 1, which includes a translation mechanism arranged between the frame and the rotation mechanism for translation of the upright parallel to the plane of rotation.

3. Device as claimed in claim 1, wherein the frame comprises at least three legs which comprise adjusting means to adjust the height thereof.

4. Device as claimed in claim 2, wherein the frame comprises at least three legs which comprise adjusting means to adjust the height thereof.

5. Device as claimed in claim 1, wherein said coupling is fixed releasably to the rotation mechanism and comprises a coupling part, the form of which is suitable for coupling thereto of the upright to be used at an angle of inclination related thereto.

6. Device as claimed in claim 1 wherein the rotation mechanism comprises a turntable.

7. Device as claimed in claim 2 wherein the translation mechanism comprises at least one Teflon bearing movable in a guide frame.

8. Device as claimed in claim 3 wherein the adjusting means are jacks.

9. Device as claimed in claim 4 wherein the adjusting means are jacks.

* * * * *